United States Patent [19]

Rhodes

[11] 4,415,442

[45] Nov. 15, 1983

[54] PROCESS FOR THE SEPARATION OF ENTRAINED ORGANIC FLUIDS FROM GASEOUS STREAMS IN A COAL DEASHING SYSTEM

[75] Inventor: Donald E. Rhodes, Oklahoma, Okla.

[73] Assignee: Kerr-McGee Corporation, Oklahoma City, Okla.

[21] Appl. No.: 305,102

[22] Filed: Sep. 24, 1981

[51] Int. Cl.[3] ..... C10G 31/00; C10G 53/04

[52] U.S. Cl. ..... 208/177; 208/8 LE; 208/48 R

[58] Field of Search ..... 208/8 LE, 177

[56] References Cited

U.S. PATENT DOCUMENTS

| | | | |
|---|---|---|---|
| 4,028,221 | 6/1977 | Sze et al. | 208/8 LE |
| 4,153,538 | 5/1979 | Leonard et al. | 208/177 |
| 4,242,102 | 12/1980 | Snell | 208/8 LE X |
| 4,244,812 | 1/1981 | Baldwin et al. . | |
| 4,248,692 | 2/1981 | Knebel et al. | 208/8 LE |

*Primary Examiner*—Delbert E. Gantz
*Assistant Examiner*—Glenn A. Caldarola
*Attorney, Agent, or Firm*—William G. Addison

[57] ABSTRACT

A process for the prevention of the deposition of entrained soluble coal products from vaporous solvent recovered from a heavy fraction comprising insoluble coal products and some solvent and soluble coal products. The heavy fraction is produced in a coal deashing system employing solvent at elevated temperatures and pressures near the critical conditions of the solvent. The heavy fraction is reduced in pressure to form a mixture of ash concentrate and vaporous solvent together with entrained soluble coal products. This mixture then is turbulently admixed for at least 0.05 seconds to coalesce or condense the entrained soluble coal products upon the ash concentrate particles. The coalescence or condensation of at least a portion of the soluble coal products substantially prevents or minimizes deposition of the same in the solvent withdrawal conduit of subsequent vapor-solid separation apparatus. Alternatively, the mixture is introduced into a fluidized bed of ash concentrate. The entrained soluble coal products then coalesce or condense on the fluidized particles by contacting the same.

2 Claims, 1 Drawing Figure

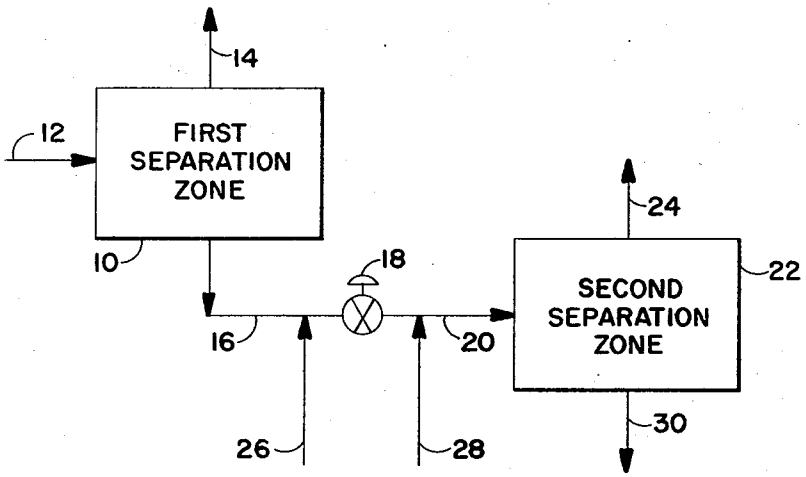
FIRST SEPARATION ZONE
SECOND SEPARATION ZONE
10
12
14
16
18
20
22
24
26
28
30

PROCESS FOR THE SEPARATION OF ENTRAINED ORGANIC FLUIDS FROM GASEOUS STREAMS IN A COAL DEASHING SYSTEM

BACKGROUND OF THE INVENTION

1. Field of the Invention

This invention relates to a process for separating entrained organic fluids from gaseous streams in a coal deashing system utilizing an ash concentrate produced by the system while operating at elevated temperatures and pressures.

2. Description of the Prior Art

Heretofore, coal has been mixed with certain solvents at elevated temperatures and pressures to produce mixtures of dissolved and undissolved coal. Various systems have been proposed for separating the dissolved coal from the undissolved coal.

In U.S. Pat. No. 4,244,812, assigned to the same assignee as the present invention, an improved system is disclosed for effecting such a separation.

In that system, a feed mixture comprising soluble coal products, solvent and insoluble coal products is separated in a first separation zone maintained at an elevated temperature and pressure into a first light fraction and a first heavy fraction comprising insoluble coal products and some solvent. The first heavy fraction also includes a small quantity of relatively low melting point soluble coal products such as coal tars that are dissolved in the solvent. The insoluble coal products comprise the undissolved coal, mineral matter, other solid inorganic particulate matter and other such matter which is insoluble in the solvent solution under the operating conditions of the process.

The first heavy fraction is withdrawn from the first separation zone and the pressure level is reduced at least about 100 psig. and preferably at least about 500 psig. to vaporize the solvent and yield the insoluble coal products in a relatively dry, powdery form referred to as "ash concentrate." Upon the vaporization of the solvent from the first heavy phase, a portion of the formerly soluble coal tars and other organic fluids separate from the remainder of the heavy phase and are entrained in the vaporized solvent in the form of a fog or atomized mist. The flashed heavy phase then is introduced into another separation zone, such as for example, a cyclone or gravity settler, to separate the ash concentrate from the vaporized solvent. The vaporized solvent is passed from this separation zone through a withdrawal conduit for recycle in the process. Since the organic fluids are at a temperature near to or above their melting point, they exhibit a highly viscous behavior and tend to deposit upon and adhere to the inside of the solvent withdrawal conduit. In some instances a small quantity of the fine particles of ash concentrate also are entrained in the withdrawn solvent stream together with the entrained organic fluids. If the relatively dry ash concentrate contacts the coating of organic fluids within the solvent withdrawal conduit, it can adhere to the coating. An agglomerate can form through continued collection of organic fluids and ash concentrate which will block the solvent withdrawal conduit. The formation of such a blockage requires termination of process operation to permit removal of the agglomerate. A tedious and expensive cleanout then is required to restore operation.

It would be desirable to provide a method by which the blockage problem associated with the separation of the solvent from the first heavy fraction withdrawn from the first separation zone can be alleviated.

SUMMARY OF THE INVENTION

The surprising discovery now has been made that the ash concentrate produced by the previously described system can be used to remove the organic fluids present in the vaporized solvent of that system. In operation, the first heavy fraction produced by the previously described system is withdrawn from the separation zone and the pressure level is reduced at least about 100 psig. by passage of the same through a pressure reduction valve. The pressure reduction results in the vaporization of a substantial portion of the solvent contained in the heavy fraction and yields the insoluble coal products in the powdery form referred to as ash concentrate. The vaporization of the solvent also results in the formation of the fog or atomized mist of organic fluids that is associated with the solvent. The fog of organic fluids is separated from the vaporized solvent by scrubbing with the ash concentrate. The scrubbing is effected by maintaining the ash concentrate and vaporized solvent together with the fog of organic fluids in contact for from about 0.1 to 10 seconds under turbulent flow conditions. The turbulent flow conditions can be created by the addition of solvent to the heavy fraction in advance of the pressure reduction step such that the added solvent then vaporizes by passage through the pressure reduction valve to increase the flow rate of gas and hence the turbulence within the transfer conduit. Alternatively, any carrier fluid which is substantially nonreactive with the materials present within the transfer conduit can be introduced into the transfer conduit to assist in maintaining the turbulent flow conditions. The mixture of vaporized solvent and ash concentrate then is introduced into another separation zone to separate the ash concentrate from the now scrubbed vaporized solvent. The vaporized solvent is passed from the separation zone through a withdrawal conduit for recycle in the process. The scrubbing of the vaporized solvent removes the entrained organic fluids which then prevents deposition of the same in the solvent withdrawal conduit. This prevents formation of the agglomerate.

In an alternate embodiment of the invention, the mixture of ash concentrate and vaporized solvent together with the fog or organic fluids can be introduced into a separation zone which contains a fluidized bed of ash concentrate. The inlet of the mixture into the fluidized bed is positioned such that the vaporized solvent is retained within the fluidized bed for a sufficient time to remove the entrained organic fluids by contact with the particles in the bed. The scrubbed vaporized solvent then can be withdrawn through a conduit for recycle in the process.

BRIEF DESCRIPTION OF THE DRAWING

The drawing is a schematic, diagrammatic illustration of the process of this invention.

DESCRIPTION OF THE PREFERRED EMBODIMENT

In the practice of the invention disclosed in U.S. Pat. No. 4,244,812, the disclosure of which is incorporated herein by reference, a feed mixture (comprising soluble coal products, insoluble coal products and solvent) is passed from a mixing zone through a conduit into a first separation zone maintained at an elevated temperature and pressure. In the first separation zone, the feed mixture is separated into a first heavy fraction and a first light fraction. The first light fraction is withdrawn and passed into a second separation zone. The first heavy fraction is withdrawn from the first separation zone and the pressure is reduced at least 100 psig. to yield a relatively dry, powdery ash concentrate composition.

Turning now to FIG. 1 of the present invention, a feed mixture (comprising soluble coal products, insoluble coal products and solvent) enters a first separation zone 10 by a conduit 12. Sufficient solvent is present in the feed mixture to provide a ratio by weight of solvent to soluble coal products and insoluble coal products of from about 1:1 to about 10:1. It is to be understood that larger quantities of solvent can be present, however, such quantities are not required. The first separation zone 10 is maintained at a temperature level below about 700° F. and at a pressure level in the range of from about the critical pressure of the deashing solvent to about 1500 psig. to effect the separation. Preferably, first separation zone 10 is maintained at a temperature in the range of from about 400° F. to below about 700° F. and at a pressure level in the range of from about 700 psig. to about 1000 psig.

In first separation zone 10, the feed mixture separates into a first light fraction comprising soluble coal products and solvent and a first heavy fraction comprising insoluble coal products and some solvent. The first heavy fraction also includes a small quantity of relatively low melting point soluble coal products such as coal tars and other organic fluids that are dissolved in the solvent.

The first light fraction is withdrawn from the first separation zone 10 by a conduit 14 for subsequent processing (not shown).

The first heavy fraction is withdrawn from the first separation zone 10 through a conduit 16 and is passed through a pressure reduction means 18, such as for example, a pressure reduction valve. During passage of the first heavy fraction through the pressure reduction means 18, the pressure level of the first heavy fraction is reduced at least 100 psig. Preferably, the pressure level of the first heavy fraction is reduced at least 500 psig. The pressure reduction flashes the first heavy fraction to form one stream comprising solvent and one stream comprising the insoluble coal products now referred to as ash concentrate which pass together through a transfer conduit 20 to enter a second separation zone 22 comprising a receiver vessel. The receiver vessel can comprise a cyclone, gravity settler or the like. The ash concentrate is collected in the receiver vessel of second separation zone 22 and the solvent is withdrawn from the zone through a conduit 24 for re-utilization in the preparation of additional feed mixture.

The distance traversed by conduits 16 and 20 can be minimal, or the length of either or both of the conduits 16 or 20 can be substantial, that is, over several feet.

In some instances it has been found that the small quantity of soluble coal products, hereinafter also referred to as "organic fluid", which are dissolved or otherwise entrained within the heavy phase may separate therefrom upon flashing and become entrained in the vaporized solvent as an atomized mist or fog. This mist tends to separate from the vaporized solvent during withdrawal and form a deposit on the interior surface of solvent withdrawal conduit 24. A portion of the fine particles of ash concentrate also can be entrained in the vaporized solvent as a result of the velocity of the gaseous solvent stream through the receiver vessel. Since the entrained organic fluid has a relatively low melting point, the coating that is formed in conduit 24 is highly adhesive and tends to cause any particles of ash concentrate which contact it to adhere thereto and form an agglomerate. These particles then are coated with a new deposit of organic fluids. The successive accumulation of layers of organic fluid and ash concentrate can result in the complete blockage of conduit 24. The blockage results in the termination of the discharge of the first heavy fraction from first separation zone 10 and may result in the ultimate termination of the deashing process operation.

To alleviate the blockage problem, the mixture of ash concentrate and vaporized solvent together with the mist present therein is turbulently admixed within conduit 20 by maintaining turbulent flow conditions in the vaporous solvent stream to scrub the fog from the vaporized solvent. The turbulent flow conditions effectively cause the mist of organic fluids to coalesce or condense on the fine ash concentrate particles of the mixture. The turbulent flow condition must be maintained for at least about 0.05 seconds. Preferably, the turbulent flow condition is maintained for from about 0.1 to 10 seconds. The coalescence or condensation of the entrained soluble coal products prevents or substantially minimizes deposition of the soluble coal products in the subsequent solvent withdrawal conduit 24.

The turbulent flow conditions can be achieved by the addition of a carrier fluid, such as solvent or the like, introduced through a conduit 26 into the heavy fraction in conduit 16 before pressure reduction and then flashing the carrier fluid together with the solvent to increase the quantity and flow rate of the vaporous products. Alternatively, the carrier fluid can be introduced into conduit 20 through a conduit 28 in such a manner that a turbulent flow profile is maintained by the vaporous solvent within conduit 20. The carrier fluid can comprise any liquid or gaseous material that generally is nonreactive under the process conditions with the materials in conduit 20 and that is capable of providing the desired turbulent flow profile in the vaporous solvent.

The turbulently flowing mixture then enters separation zone 22 wherein the now scrubbed vaporized solvent is separated from the ash concentrate together with the coalesced organic fluids. Separation zone 22 can comprise any conventional vapor-solid separation apparatus, such as, for example, a cyclone separator or the like. The vaporized solvent passes from separation zone 22 through withdrawal conduit 24 for recycle in the process without any significant accumulation or deposition of organic fluids in the withdrawal conduit. The ash concentrate is withdrawn from separation zone 22 through a conduit 30.

In an alternate embodiment of the invention, the mixture of ash concentrate and vaporized solvent together with the fog of entrained organic fluids formed upon pressure reduction of the heavy phase is introduced into a separation zone which comprises a vessel containing a fluidized bed of ash concentrate. The inlet for the mixture into the fluidized bed is positioned sufficiently below the top surface of the bed such that the solvent and entrained organic fluids are retained in contact with the fluidized particles for a sufficient time to coalesce or condense the entrained organic fluids on the ash concentrate. The coalescence or condensation of at least a portion of the entrained soluble coal products upon the fluidized ash concentrate particles prevents or substantially minimizes deposition of the soluble coal products in solvent withdrawal conduit 24. In a preferred embodiment, the vaporized solvent provides at least a portion of the fluidizing gas employed to maintain the bed of ash concentrate particles in the fluidized condition. The fluidizing gas also can comprise any other fluid that is generally nonreactive with the materials present in the mixture entering the fluidized bed under the operating conditions of the process. For example, the fluidizing gas can comprise nitrogen, steam or the like. Preferably, the depth of the fluidized bed above the inlet for the mixture is such as to provide a residence time for the vaporized solvent of the mixture in the bed of from about 1.0 to 10 seconds. While longer residence times can be employed such longer times are unnecessary to achieve the desired removal of entrained organic fluids. The fluidized bed provides the additional benefit of filtering the ash concentrate from the vaporized solvent in the mixture introduced into the fluidized bed. The organic fluid-coated ash concentrate particles can be withdrawn from the base of the fluidized bed and can be fed, for example, to a gasifier to recover additional hydrocarbon values. The withdrawal rate can be adjusted such that the bed is maintained at an uniform depth by withdrawal of a portion of the organic fluid-coated ash concentrate which is equal to the quantity of ash concentrate introduced into the fluidized bed in the mixture with the vaporized solvent.

To further illustrate the present invention and not by way of limitation, a feed mixture comprising 3 parts of benzene to one part of coal liquefaction products comprising soluble coal products and insoluble coal products is introduced into a first separation zone. The first separation zone is maintained at a temperature of about 550° F. and a pressure of about 800 psig. to effect a separation of the feed mixture into a light fraction and a heavy fraction. The heavy fraction is withdrawn and passed through a pressure reduction means which reduces the pressure level of the heavy phase to about 50 psig. to vaporize a substantial portion of the solvent present and yield ash concentrate. The pressure reduction also results in the formation of a mist of organic fluids in association with the vaporized solvent.

The flashed heavy phase is introduced into a receiver vessel wherein the vaporized solvent is separated from the remainder of the heavy phase comprising ash concentrate. The vaporized solvent is withdrawn from the upper portion of the receiver vessel through a withdrawal conduit. The vaporized solvent is in contact with the ash concentrate for from about 0.01 to 0.02 seconds.

The solvent withdrawal conduit plugs with an agglomerate comprising organic fluids and ash concentrate after a short period of continuous operation.

The operation of the process then is discontinued and the solvent withdrawal conduit is cleaned out. An extension then is inserted in the conduit connecting the pressure reduction means to the receiver vessel and process operation is resumed.

The first separation zone is operated as previously described and the first heavy fraction is withdrawn and passed through the pressure reduction means. The vaporized solvent and entrained organic fluids then pass through the conduit extension to enter the receiver vessel. Nitrogen gas is introduced into the conduit after the pressure reduction means at a rate sufficient to create turbulent flow conditions in the vaporized solvent present in the conduit. The length of the conduit extension is such that the vaporized solvent remains in turbulent contact with the ash concentrate for about 0.2 seconds before entering the receiver vessel.

The vaporized solvent is separated from the ash concentrate in the receiver vessel and then is withdrawn from the upper portion of the receiver vessel through the solvent withdrawal conduit. After 48 hours of operation the process is discontinued and the solvent withdrawal conduit is inspected. The conduit is found to contain no significant accumulation of deposited organic fluids or ash concentrate.

The receiver vessel and conduit connecting the receiver vessel to the pressure reduction means then are replaced with a vessel containing a fluidized bed of ash concentrate. Process operation then is resumed. The heavy phase, formed as previously described, is reduced in pressure to a level of about 50 psig. by passage through the pressure reduction means and introduced directly into a lower portion of the fluidized bed. The bed of ash concentrate particles is fluidized by injecting steam into the base of the vessel. The depth of the bed is such that the vaporized solvent is retained in contact with the particles of the bed for about 4 seconds. The vaporized solvent then is removed through the solvent withdrawal conduit for recycle in the process. Ash concentrate is removed from the base of the fluidized bed at a rate equal to that of the ash concentrate entering the vessel with the vaporized solvent.

After 48 hours of continuous operation, the process is discontinued. The solvent withdrawal conduit then is inspected. The solvent withdrawal conduit is found to contain no significant accumulation of deposited organic fluids or ash concentrate.

The foregoing results clearly demonstrate the effectiveness of the present invention in alleviating the blockage problem associated with the withdrawal of the vaporized solvent from the second separation zone.

In the process described above, the term "solvent" means a fluid consisting essentially of at least one substance having a critical temperature below 800° F. selected from the group consisting of: aromatic hydrocarbons having a single benzene nucleus and normal boiling points below about 310° F., such as benzene, toluene, o-, m- and p-xylene, ethyl benzene, isopropyl benzene and monocyclic aromatic hydrocarbons in general having normal boiling points below about 310° F.; cycloparaffin hydrocarbons having normal boiling points below about 310° F., such as cyclobutane, cyclopentane, cyclohexane, cycloheptane and nonaromatic monocyclic hydrocarbons in general having normal boiling points below about 310° F.; open chain monoolefin hydrocarbons having normal boiling points below about 310° F., such as butene, pentene, hexene and heptene; open chain saturated hydrocarbons having normal boiling points below about 310° F., such as pentane, hexane and heptane; mono-, di, and tri-open chain amines containing from about 2–8 carbon atoms, such as ethyl, propyl, butyl, pentyl, hexyl, heptyl, and octyl amines; carbocyclic amines having a monocyclic structure containing from about 6–9 carbon atoms, such as aniline and its alkyl homologs; heterocyclic amines containing from about 5–9 carbon atoms, such as pyridine and its alkyl homologs; and phenols containing from about 6–9 carbon atoms and their homologs. Such fluids and their usefulness is described further in U.S. Pat. Nos. 3,607,716 and 3,607,717 the disclosures of which are incorporated herein by reference.

The term "soluble coal products" means the constituents of the feed that are soluble in the deashing solvent under the conditions of this invention.

The term "insoluble coal products" means undissolved coal, mineral matter, other solid inorganic particulate matter and other such matter which is insoluble in the deashing solvent under the conditions of this invention.

The term "ash concentrate" means the insoluble coal product composition which has been separated from the soluble coal products and the solvent removed therefrom.

While the present invention has been described with respect to what at present is considered to be the preferred embodiments thereof, it is to be understood that changes or modifications can be made in the process without departing from the spirit or scope of the invention as defined by the following claims.

What is claimed is:

1. In a process for separating a feed mixture comprising soluble coal products, insoluble coal products and a solvent in a first separation zone, said solvent comprising at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di- and tri-open chain amines containing from about 2–8 carbon atoms, carbocyclic amines having a monocyclic structure containing from about 6–9 carbon atoms, heterocyclic amines containing from about 5–9 carbon atoms and phenols containing from about 6–9 carbon atoms and their homologs, in which said feed mixture is maintained in said first separation zone at an elevated temperature and pressure to separate said feed mixture into a light fraction and a heavy fraction comprising insoluble coal products and some solvent including some soluble coal products dissolved therein and in which withdrawing said heavy fraction from said first separation zone and reducing the pressure level of said heavy fraction at least about 100 psig. results in the formation of a mixture of an ash concentrate and vaporous solvent together with entrained soluble coal products and separation of said vaporous solvent together with said entrained soluble coal products from said ash concentrate results in a deposition of said entrained soluble coal products upon the interior surface of a withdrawal conduit through which said separated vaporous solvent is passed, the improvement which comprises:

separating said mixture comprising ash concentrate and vaporous solvent together with said entrained soluble coal products in a fluidized bed comprising ash concentrate having an upper portion connected to said solvent withdrawal conduit, said mixture being introduced a sufficient depth below the top surface of said fluidized bed to cause said vaporous solvent to remain in contact with the ash concentrate particles in said fluidized bed for a sufficient time to coalesce or condense at least a portion of said entrained soluble coal products thereon and thereby separate the same from the vaporous solvent to prevent or substantially minimize deposition of said soluble coal products in said solvent withdrawal conduit.

2. The process of claim 1 wherein the vaporous solvent is contacted with the fluidized particles of ash concentrate for from about 1.0 to about 10 seconds.

* * * * *